US006511243B2

(12) United States Patent
Miranda

(10) Patent No.: US 6,511,243 B2
(45) Date of Patent: Jan. 28, 2003

(54) CONTAINER FOR STORING AND APPLYING A LIQUID DEODORANT

(75) Inventor: Renato Miranda, Sao Paulo (BR)

(73) Assignee: Filtrona Brasileira Industria E Commercio Ltda., Sao Paulo (BR)

( * ) Notice: Subject to any disclaimer, the term of this patent is extended or adjusted under 35 U.S.C. 154(b) by 0 days.

(21) Appl. No.: 09/982,137

(22) Filed: Oct. 12, 2001

(65) Prior Publication Data

US 2002/0044818 A1 Apr. 18, 2002

(30) Foreign Application Priority Data

Oct. 16, 2000 (BZ) ..... 8002322 U

(51) Int. Cl.[7] ..... B43K 23/08
(52) U.S. Cl. ..... 401/213; 401/131; 401/209
(58) Field of Search ..... 401/213, 209, 401/210, 211, 212, 214, 215, 216, 217, 131

(56) References Cited

U.S. PATENT DOCUMENTS 4,571,106 A * 2/1986 Scuderi ..... 401/213
5,180,242 A * 1/1993 De Laforcade ..... 401/213
5,263,787 A * 11/1993 Wilcox et al. ..... 401/131
6,095,708 A * 8/2000 Butaud ..... 401/213

* cited by examiner

*Primary Examiner*—David J. Walczak
(74) *Attorney, Agent, or Firm*—Darby & Darby

(57) ABSTRACT

Container for storing and applying a liquid deodorant, of the type comprising: a tubular body (10) provided with an end mouth (11), which retains a free rotating ball (20) projecting partially outwardly from the tubular body (10); and a cap (30) having an end wall (31), which is provided in order to define a surface for seating the container in an inverted position.

3 Claims, 1 Drawing Sheet

CONTAINER FOR STORING AND APPLYING A LIQUID DEODORANT

FIELD OF THE INVENTION

The present invention refers to a container, which is designed to allow the storage of a load of liquid deodorant and the application thereof to the user's body by the roll-on system.

BACKGROUND OF THE INVENTION

There are well known from the prior art the containers for storing and applying liquid deodorants of the roll-on type, consisting of a tubular body, which itself defines the manual grasping means for the user and presents a mouth in the form of a spherical annular bearing, into which is retained a free rotating ball, partially projecting outwardly from the tubular body, maintaining a portion of its surface turned to the inside of the tubular body, in order to be wetted by the load of liquid deodorant stored in said container.

The rotation of the ball, by contacting the user's body during the displacement of the container, allows the surface portion of the ball, which is wetted by the liquid deodorant, to contact the user's skin, transferring to the latter the liquid deodorant that has been aggregated to the ball inside the tubular body.

Although being very practical and of easy construction, this type of container for storing and applying a liquid deodorant presents an inconvenience which increases as the load of deodorant is being consumed.

Generally, when the load of liquid deodorant is reduced to about half the original volume or less, the user has to agitate the container before using the deodorant, in order to make the liquid load reach the surface portion of the ball turned to the inside of the container, wetting said surface portion and allowing said liquid load to be transferred to the user's body by rotation of said ball.

In these known roll-on type constructions, when the load of liquid deodorant is reduced inside the container, the transfer of said load to the ball does not occur with the normal movement imparted to the tubular body by the user, when he/she simply takes said container from its inoperative resting position, in which said container is resting on its bottom, with the ball facing upwardly. To make the liquid wet the ball, the user has to shake the stored product, otherwise he/she will not be able to obtain the necessary transfer of the deodorant to the surface portion of the ball facing the inside of the container.

OBJECT OF THE INVENTION

It is an object of the present invention to provide a container of the type considered herein, which allows the ball to be constantly and adequately wetted by the load of liquid deodorant, without requiring the user to agitate the container.

It is a further object of the present invention to provide a container, which cannot be placed in a way that makes difficult or avoids the ball from being automatically wetted by the liquid deodorant.

SUMMARY OF THE INVENTION

The container for storing and applying a liquid deodorant of the present invention is of the type described in the beginning of the specification, presenting a cap with a tubular shape, incorporating an end wall provided so as to define a surface for seating the container in an inverted position, with the end mouth facing downwardly.

With the construction defined above, the ball is constantly maintained in contact with the liquid load stored in the container, allowing the efficient application of the liquid deodorant, without requiring the user to shake the container before use, even when only a small amount of the liquid remains in the container.

BRIEF DESCRIPTION OF THE DRAWINGS

The invention will be described below, with reference to the attached drawing, in which.

DESCRIPTION OF THE ILLUSTRATED EMBODIMENTS

As illustrated, the container of the present invention comprises a tubular body 10, which is made of plastic or any other material, with a substantially cylindrical contour, or with any other cross-section, and which is provided with an end mouth 11 in the form of a spherical annular bearing, inside which is retained, in a tight but freely rotating way, a ball 20 partially projecting outwardly from the tubular body 10.

Figure 3:
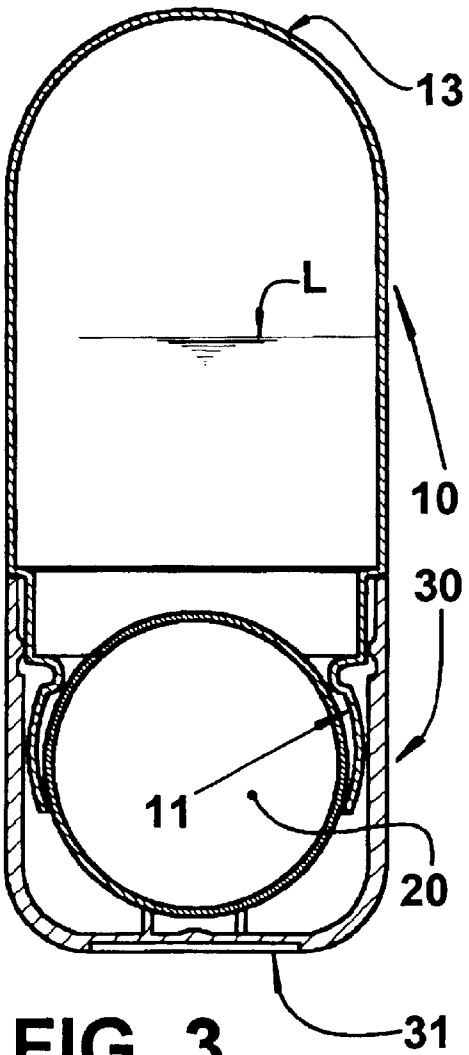
FIG. 3 is a longitudinal diametrical sectional view of the container in the position illustrated in FIG. 1.
Figure 2:
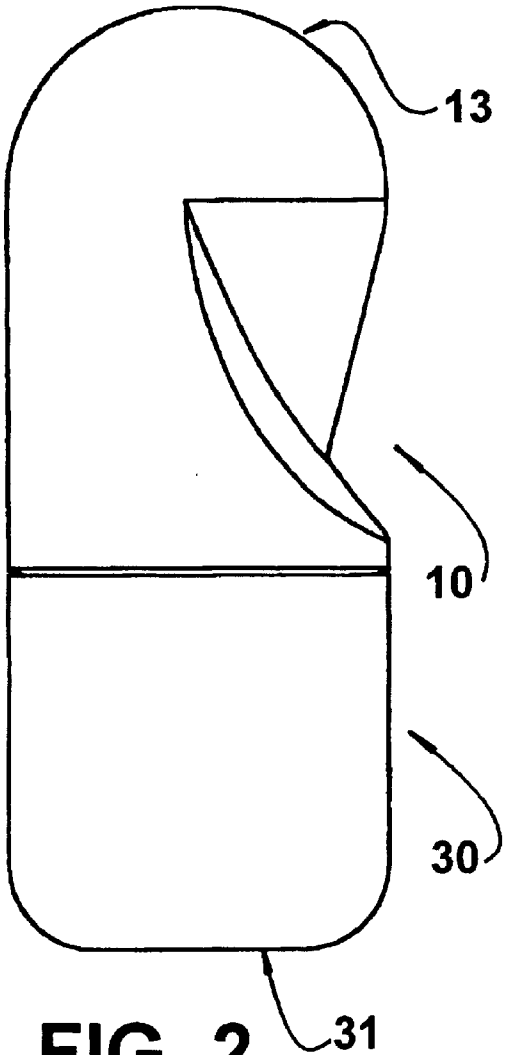
FIG. 2 is a lateral elevational view of the container of FIG. 1.
Figure 1:
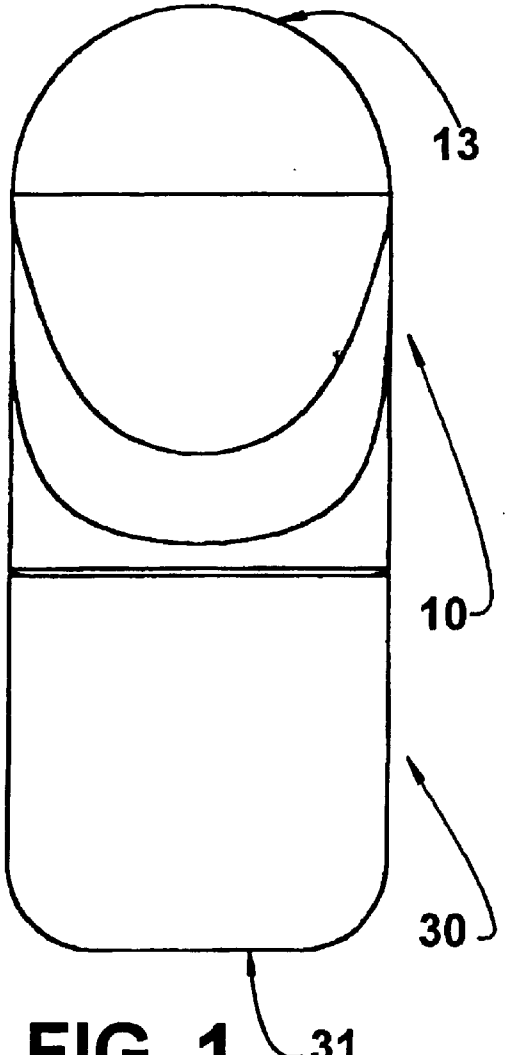
FIG. 1 is a front elevational view of part of the present container in its resting inoperative position, seated on any surface.

The end mouth 11 may be formed in a single piece, with the container defining the spherical annular bearing, such as illustrated in FIG. 3, or it may include an insert mounted in the respective opening of the container, in order to define in said opening the spherical annular bearing.

The tubular body 10 may incorporate a thread, which is provided external and close to the end mouth 11, in order to receive and retain a cap 30, which is usually but not necessarily made of plastic material and has a tubular shape, and which in this case is internally threaded. It should be understood that the cap 30 might be fitted to the tubular body 10 by other ways that dispense the provision of threads.

According to the present invention, the cap 30 has an end wall 31, which is designed to define a surface for seating the container in an inverted position, with the end mouth 11 facing downwardly, allowing the liquid deodorant L stored in the container to remain in contact with the ball 20.

In order to force the user to seat the container, when not in use, by the end wall 31 of the cap 30, the tubular body 10 incorporates a bottom wall 13, which is designed to avoid the definition of a seating surface for the container. In the illustrated example, the bottom wall 13 takes the approximate form of an inverted spherical calotte. It should be understood that the bottom wall 13 may have other forms, provided that they operate similarly, that is, preventing the user from using said bottom wall 13 as the seating surface for the container.

What is claimed is:

1. Container for storing and applying a liquid deodorant comprising:

a tubular body for containing the liquid having a mouth at one end in the form of a spherical annular bearing, which retains a free rotating ball projecting partially outwardly from the tubular body; and a tubular cap having a peripheral outer shape of a size at least that of said tubular body and having a first end which is fittable to the tubular body to cover the end mouth and a second end with a wall to define a surface for seating the container in an inverted position with the end mouth facing downwards, and wherein the other end of said tubular body is closed and has an outer surface that includes a convex nonflat bottom portion which prevents stable seating of said tubular body on said other end.

2. Container, according to claim 1 wherein said other end of said tubular body has the approximate form of a spherical colotte.

3. Container according to claim 1 wherein said tubular body is of rigid material.

* * * * *